United States Patent [19]

Nagai

[11] 4,357,117

[45] Nov. 2, 1982

[54] NIB HOLDER CONSTRUCTION FOR WRITING IMPLEMENTS

[75] Inventor: Masahiko Nagai, Tokyo, Japan

[73] Assignee: Ogawa Chemical Industries, Ltd., Tokyo, Japan

[21] Appl. No.: 125,916

[22] Filed: Feb. 29, 1980

[30] Foreign Application Priority Data

Nov. 8, 1979 [JP] Japan ..... 54-155553[U]

[51] Int. Cl.[3] ..... B43K 5/16; B43K 21/08; A45D 40/04

[52] U.S. Cl. ..... 401/68; 401/74; 401/199; 401/207

[58] Field of Search ..... 401/58, 68, 73, 116, 401/198, 199, 207, 74

[56] References Cited

U.S. PATENT DOCUMENTS

| | | | |
|---|---|---|---|
| Re. 25,741 | 3/1965 | Smith | 401/58 |
| 946,149 | 1/1910 | Newman | 401/207 |
| 1,122,559 | 12/1914 | Wade | 401/116 |
| 2,039,466 | 5/1936 | Wahl | 401/68 |
| 2,504,420 | 4/1950 | Hull | 401/116 |
| 2,913,747 | 11/1959 | Hempel | 401/198 |
| 3,221,361 | 12/1965 | Cline | 401/198 |
| 3,325,851 | 6/1967 | Roller | 401/198 |
| 3,399,021 | 8/1968 | Matsumoto | 401/199 |
| 3,418,056 | 12/1968 | Derbins | 401/199 |

FOREIGN PATENT DOCUMENTS

| | | | |
|---|---|---|---|
| 800211 | 12/1968 | Canada | 401/198 |
| 395604 | 1/1909 | France | 401/68 |
| 13640 | of 1890 | United Kingdom | 401/68 |
| 941439 | 11/1963 | United Kingdom | 401/198 |
| 1086310 | 10/1967 | United Kingdom | 401/198 |

*Primary Examiner*—Clyde I. Coughenour

*Attorney, Agent, or Firm*—Oblon, Fisher, Spivak, McClelland & Maier

[57] ABSTRACT

A nib holder for a fine molded nib in a writing instrument is disclosed. The nib holder has an internal passageway into which the nib may be inserted and held by an abrasive ring or by projections, the nib being held without substantial deformation thereof. The nib holder includes a screw threaded portion which cooperates with mating screw threads on the casing of the writing implement. The nib holder may be screwed into the casing until the end of the nib contacts a fixed ink conducting core. Therefore, as the nib holder is screwed into the casing, the nib is forced out of the passage in the holder for compensating for wear of the nib. A cooperating prong and detent on the casing and nib holder control the rotation of the nib holder with respect to the casing.

4 Claims, 8 Drawing Figures

NIB HOLDER CONSTRUCTION FOR WRITING IMPLEMENTS

BACKGROUND OF THE INVENTION

1. Field of the Invention

This invention relates to a nib holder for a writing implement with a fine nib, and more particularly to improvements in a nib holder which is particularly useful for a drafting or drawing pen with a very fine nib.

2. Description of the Prior Art

Writing utensils with fine nibs (e.g., nibs having a diameter smaller than 1 mm, or fine pens) are well known in the art but they all have the following problems or drawbacks.

Firstly, irrespective of the nib attaching construction, the nib becomes worn out by abrasion before consuming the entire amount of ink which is provided within a casing cylinder (in most cases the ink is impregnated into an absorbent reservoir which is accommodated within the casing cylinder). Therefore, the worn-out nibs have to be thrown away which is wasteful. This is a great disadvantage in view of the recent trend to save natural resources and energy. Experiments on known pens have revealed that a pen with a fine nib of 0.8 mm in diameter is worn out by 1000 m of writing, barely consuming 35% of the reserved ink thereby leaving a major portion of the ink in the reservoir.

Secondly, in the known writing implements having a nib secured in a narrow tube which is fixed in a holder, there invariably arises a problem with regard to the means for securing the nib to the narrow tube. For example, it is known to caulk a part of the narrow tube to secure the nib therein. In such a case, however, the nib is often deformed in a certain part thereof to thereby narrow or block the internal ink passage of the tube, impeding the smooth flow of the ink therethrough. In addition to the just mentioned construction, there has also been proposed and known a nib holding construction wherein a thin tube which receives a nib is circumferentially contracted into a smaller diameter to bite on the circumference of the nib to secure the latter in position. This nib holding construction also suffers from the problem that the ink passage is narrowed or blocked by deformation of the nib and smooth flow of the ink is thereby impeded, resulting in ink breaks during rapid or continuous writing. In addition, the tube contracting operation requires meticulous skill since the circumferential wall of the nib is apt to be damaged upon contacting the thin tube.

SUMMARY OF THE INVENTION

With the foregoing in view, the present invention has as its object the provision of a writing implement with a construction which overcomes the above-mentioned drawbacks and which can meet the demand of saving resources and energy, and in which the holder is rotatable relative to the casing cylinder for axial displacement independent of the fine nib to adjust the length of the fine nib which is protruded at the fore end of the holder. The holder and the fine nib are replaceable together or independently of each other.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
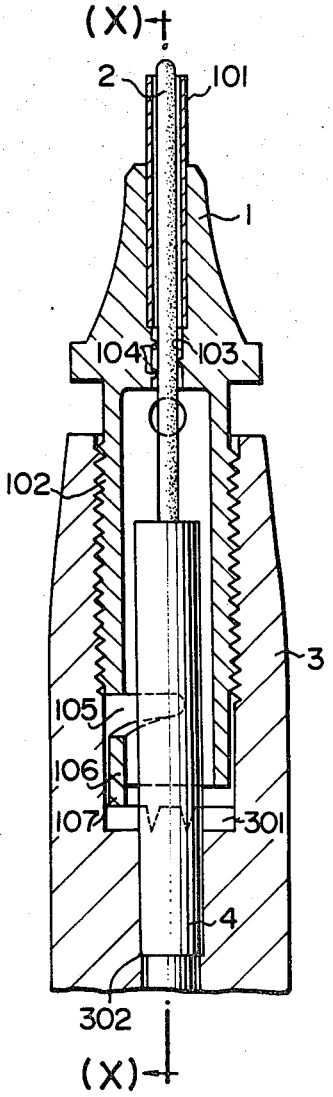
FIG. 1 is a longitudinal sectioned front view of a first preferred embodiment of the present invention.

In the first embodiment of FIGS. 1 to 5, the holder 1 is separately or integrally provided with a protruded fine tube 101 at the distal end thereof and has an externally threaded connecting portion 102 integral with the base portion thereof for engagement with internal threads on the inner periphery of the casing cylinder 3. However, the protruded fine tube 101 is optional and it need not be provided. The holder 1 is further provided with a nib gripping mechanism such as a plurality of projections 104 in the form of protuberances or protrusions formed on the inner periphery of the outer bore 103 of the holder 1, to thereby hold the nib 2 with sufficient force that the portion of the nib pressed by the projections is slightly bent. The nib holding means may also be in the form of a ring 108 of rubber, synthetic resin or other friction material which is fitted into an annular recess at the inner end of the narrow outer bore 103 shown in FIG. 7. The nib 2 is inserted into the thin tube 101 in the outer narrow bore 103 and projected out of the base portion of the holder 1. The nib gripping mechanism which is constituted by the projection 104 or the annular ring 108 grips the nib 2 with a moderate force which can yield to an intentional effort to move the nib 2 and which allows axial relative movement of the nib 2 when the holder 1 is turned into or out of the casing cylinder 3, while normally holding the nib 2 in position against mechanical vibrations or shocks. Since the nib gripping mechanism is arranged to hold the nib 2 with a moderate force, there is no possibility of damaging or deforming a fresh nib when pushing it in at the time of replacement, or of damaging or deforming the inserted nib 2 when turning the holder into or out of the casing cylinder 3. At the bottom end of the connecting portion 102, the holder 1 is provided with a slit of an inverted L-shape in side view, forming a resilient click member 106 with a prong 107 which is engageable with toothed portion 301 on a stepped wall of the casing cylinder 3. An internal screw thread is provided on the inner periphery at the fore end of the casing cylinder 3 for threaded engagement with the externally threaded connecting portion 102 of the holder 1. The toothed, stepped portion 301 which is engageable with the prong 107 of the click member 106 at the bottom end of the holder 1 is provided on the inner side of the internal thread. The toothed, stepped portion 301 is obtained by machining the stepped end face in the fashion of a gear, thereby forming the root in a profile which fits the click prong 107. The casing cylinder 3 has an ink conducting core 4 fitted thereinto. Supporting the bottom end of the core is an inner stepped wall 302 in communication with an absorbent ink reservoir (not shown). The ink from the reservoir is thus inducted through the core 4.

Figure 2:
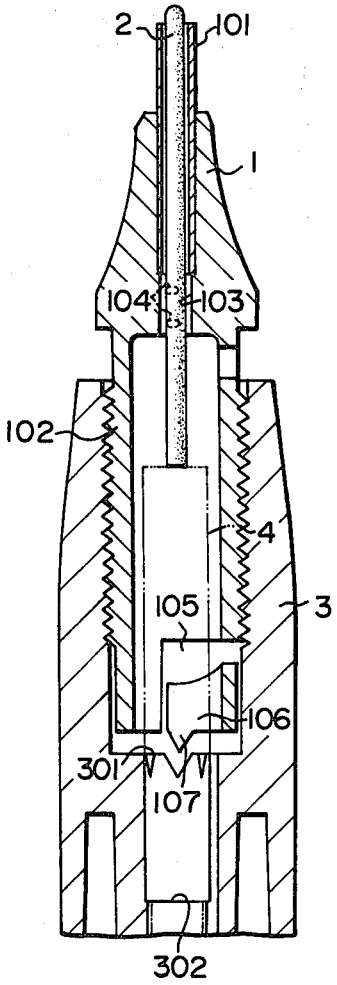
FIG. 2 is a longitudinal sectional view taken on line X—X of FIG. 1.
Figure 3:
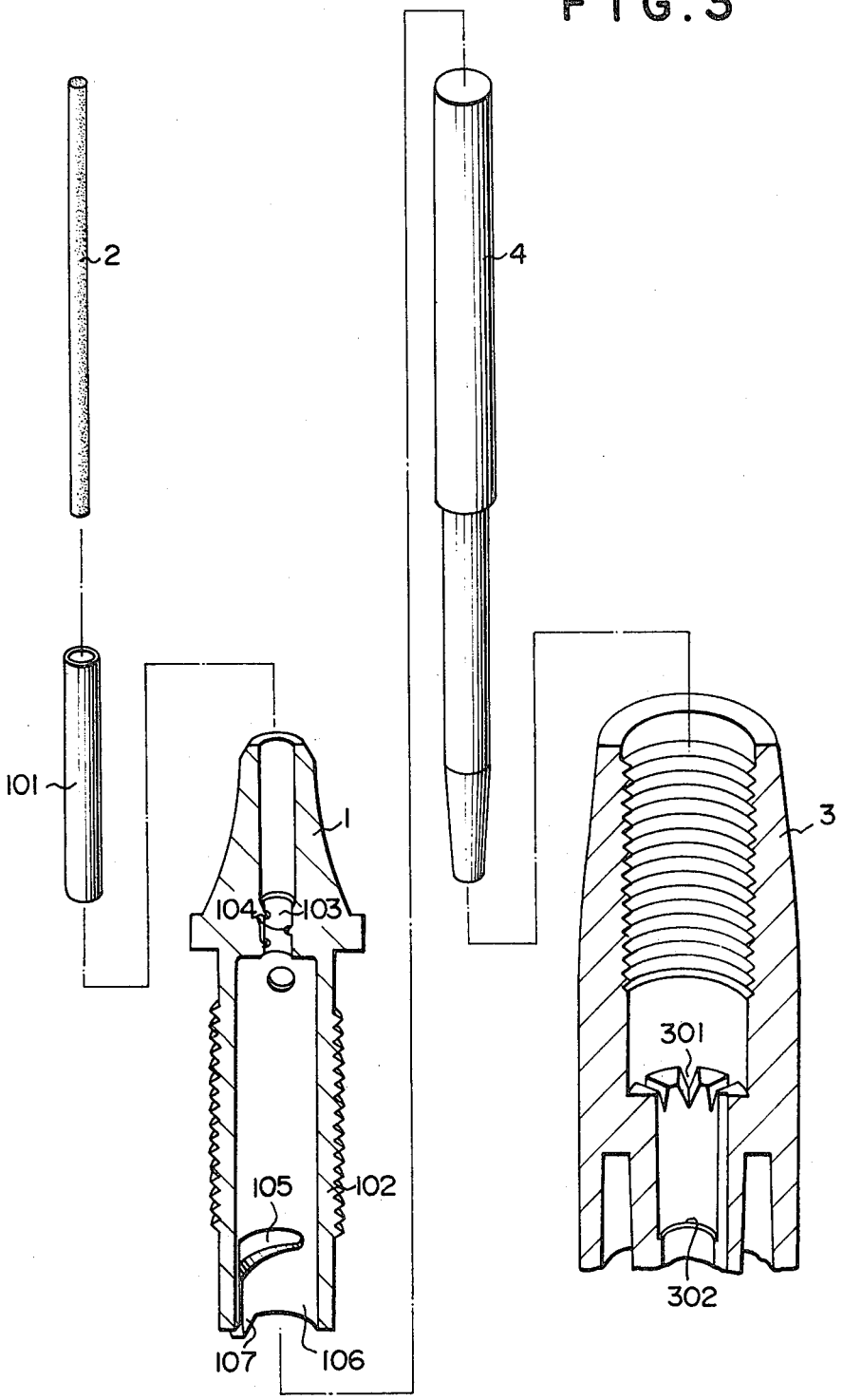
FIG. 3 is an exploded perspective view of essential component parts of the first embodiment, showing the holder and the casing cylinder in longitudinal sections.
Figure 4:
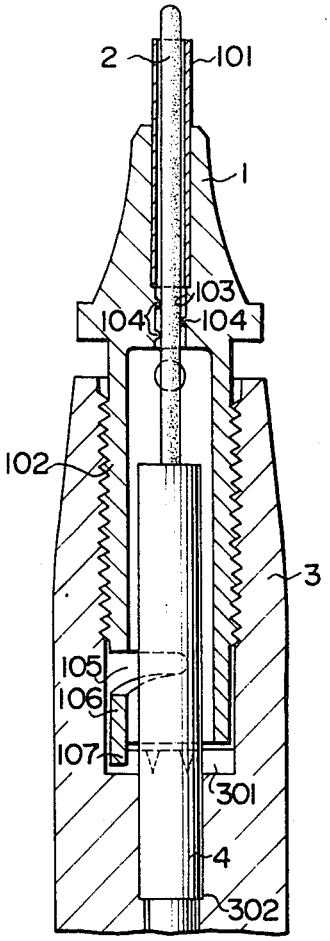
FIG. 4 is a longitudinal sectioned front view of the holder as axially retracted into the casing cylinder to adjust the protruded length of the nib.
Figure 5:
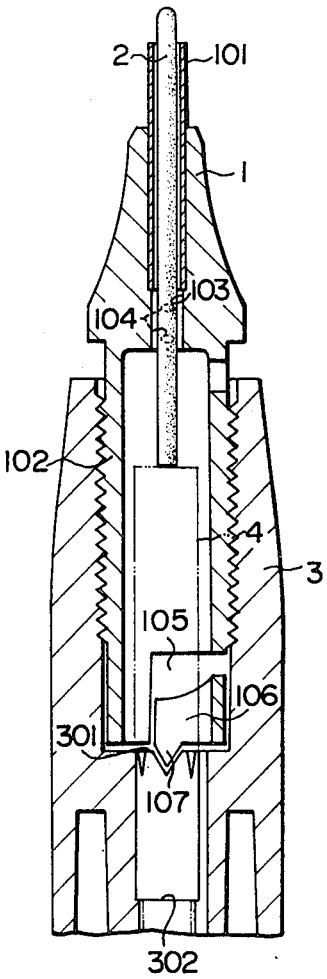
FIG. 5 is a longitudinally sectioned side view of the holder of FIG. 4.

In order to use the pen, the connecting portion 102 of the holder 1 which lightly grips the nib 2 is threaded into the casing cylinder 3 until the base end of the nib 2 is abutted against the fore end of the ink conducting core 4 as shown in FIGS. 1 and 2 so that the writing pressure exerted on the nib 2 is partly born by the ink conducting core 4. When the nib 2 is reduced by abrasion as a result of repeated or continued use, the holder 1 is turned further into the casing cylinder 3 independently of the nib 2 which is stopped by the ink conducting core 4. By the relative inward movement of the holder 1, a fresh portion of the nib 2 is protruded out of the fine tube 101 by a corresponding length as shown in FIGS. 4 and 5. Thus, it is possible to always have the nib 2 protruded out of the fine tube 101 in a desired length by incrementally turning the holder 1 into the casing cylinder 3 in a manner to compensate for the abrasion of the nib 2, thereby using the ink in the casing cylinder 3 more economically. In a case where ink still remains in the casing cylinder 3 when the holder 1 is retracted to a maximum depth or when the nib 2 is abraded to a maximum degree, the holder 1 with the nib 2 may be detached from the casing cylinder 3 and replaced with a new holder having a fresh nib of the same diameter and material as the abraded nib 2 or the nib 2 alone may be replaced. Thus, even if the nib 2 is worn out, the ink within the casing cylinder 3 can be used by attaching another holder and nib assembly or by replacing the nib 2. It may be thought that the nib 2 which is lightly gripped in the holder 1 and its thin tube 101 would come out of the holder 1 when the pen is dropped or when subjected to a mechanical shock. However, this does not occur since the nib is securely held in position by the projections 104 which are provided on the inner periphery of the outer narrow bore 103 of the holder 1 to slightly compress the circumference of the nib 2 even in the case where the nib 2 contains small dimensional errors in its diameter. The nib holder of the above-described construction cannot deform or block the ink passage to such a degree as to hinder smooth ink flow, thereby supplying a sufficient amount of ink even during speed writing or continuous writing. In a writing test using a writing implement of the construction according to the first embodiment, the nib 2 in engagement with the fore end of the ink conducting core 4 withstood a writing pressure of about 800 g, a value far exceeding the average writing pressure of 300 g, and gave satisfactory results without any trouble.

Figure 6:
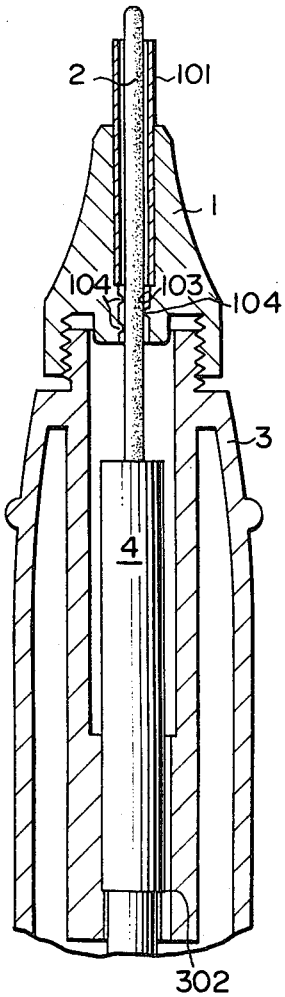
FIG. 6 is a longitudinally sectioned front view of a second preferred embodiment.

In the second embodiment shown in FIG. 6, the connecting portion 102 of the holder 1 is threaded on the fore end of the casing cylinder 3. The writing implement of this embodiment is used in the same manner as in the first embodiment to obtain the same effects.

In FIGS. 1 to 6 depicting the first and second embodiments of the invention, the nib 2 is shown in a straight form but actually it is bent by the nib gripping projections 104 of the holder 1, although to a very slight degree, to the left as seen in FIGS. 1, 4 and 6.

Figure 7:
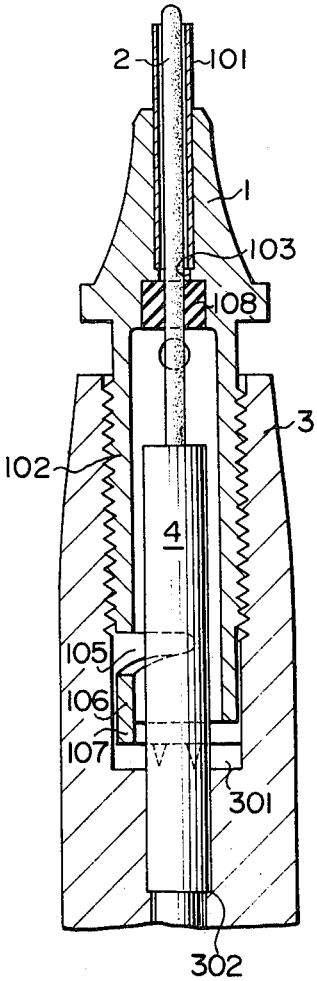
FIG. 7 is a longitudinally sectioned front view of a third preferred embodiment.

The third embodiment of FIG. 7 is the same as the first embodiment except that a ring 108 of rubber, a synthetic resin or other friction material is employed in place of the nib gripping projections 104. If desired, the ring 108 is provided with protuberances or protrusions on the inner periphery thereof for lightly gripping the circumference of the nib 2. In this third embodiment, the nib 2 is gripped in position and is maintained in unbent state. The ring 108 exerts a nib gripping force similar to that of the nib gripping projections 104 of the first embodiment. The manner of using the writing implement of the third embodiment and its effects are the same as the first embodiment. The ring 108 is fixed in an annular recess which is provided in the inner periphery of the outer narrow bore 103 of the holder 1.

Figure 8:
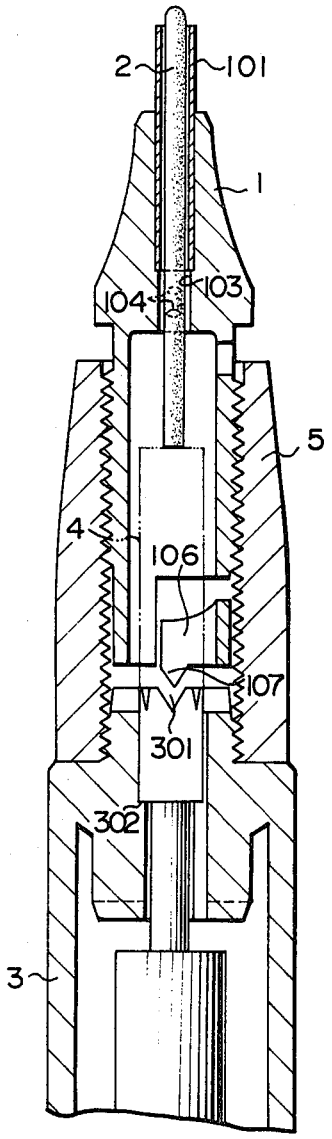
FIG. 8 is a view similar to FIGS. 6 and 7 but showing a fourth preferred embodiment of the present invention.

The embodiment of FIG. 8 is obtained by transversely severing the casing cylinder 3 of the first embodiment or the holder of the second embodiment into two separable sections. An intermediate cylinder 5 which is thereby formed between the holder 1 and casing cylinder 3 can thus be used to function as an auxiliary part of the casing cylinder 3 or as an auxiliary part of the holder 1. When the intermediate cylinder is used as an auxiliary part of the holder 1, the holder 1 is first fully threaded into the intermediate cylinder 5 and the nib 2 is inserted deep into the holder 1. Then, the intermediate cylinder 5 is threaded onto the fore end of the casing cylinder 3, whereupon the axial movement of nib 2 is blocked by engagement with the ink conducting core 4. However, the holder 1 and intermediate cylinder 5 are axially displaced until the prong 107 engages the toothed, stepped portion 301 of the casing cylinder 3 so that the fore end of the nib 2 is protruded out of the holder 1 (in the same manner as in the second embodiment).

For using the intermediate cylinder 5 as an auxiliary part of the casing cylinder 3, the nib 2 is protruded out of the holder 1 by turning the holder 1 fully into the intermediate cylinder 5 in FIG. 8, that is to say, by axially displacing the holder 1 until the prong 107 engages the toothed, stepped portion 310 (in the same manner as in the first embodiment).

It will be appreciated from the foregoing description that, according to the present invention, a fine molded nib which is fitted in the holder is projected rearward of the base end of the holder for engagement with the ink conducting core in the casing cylinder, and the holder is threaded to the fore end of the casing cylinder axially displaceable relative to the nib to compensate for abrasive wear of the nib. Therefore, when the nib is worn out, it is possible to protrude a fresh portion of the nib by axially displacing the holder or the casing cylinder for further use. This is very convenient and allows economical use of the ink which is provided in the casing cylinder. In a case where a sufficient amount of ink still remains in the casing cylinder when the nib is worn out to a maximum degree after maximum displacement of the holder, it is possible to remove the holder from the casing cylinder to replace the nib with a new one of the same diameter or to replace the holder with a new one having a nib of the same or different diameter. The nib alone, or the holder with a nib, can be replaced again and again until the ink in the casing cylinder is entirely consumed. In addition, the nib which is gripped lightly in the holder cannot deform or block the ink passage, ensuring a supply of a sufficient amount of ink in a smooth flow even during rapid or continuous writing.

The nib holder construction according to the present invention thus allows adjustment of the protruded length of the nib, economical use of the ink, smooth and sufficient supply of the ink and the use of nibs of desired diameters and material, achieving the object of eliminating the aforementioned drawbacks of the conventional writing implements.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a writing implement having a cylindrical casing including an ink storing body, an ink passage having a rigid fixed absorbent ink conducting core therein, and a thin nib, a nib holder comprising:

a holder body having two ends and a passage in said holder body, said passage in said holder body extending between said ends, said passage in said holder body adapted to receive said nib;

at least one nib holding projection in said passage in said holder body, said at least one nib holding projection extending into said passage in said holder body by a distance sufficient that, when a nib is in said passage in said holder body, said nib is of sufficient rigidity to be moved yet held without substantial deformation by said at least one nib holding projection such that relative movement between said nib and nib holder is permitted; and means on at least one of said cylindrical casing and one end of said holder body for engaging said one end with said cylindrical casing, said means for engagement permitting adjustment of the position of said holder body with respect to the length of said cylindrical casing, said means for engagement being of such a length in the direction of adjustment so as to provide secure engagement between said cylindrical casing and said holder body in at least two adjustment positions; wherein said nib contacts said fixed ink conducting core when said holder body is engaged with said cylindrical casing and said core is sufficiently rigid to overcome the grip of said at least one projection on said nib, whereby the adjustment of said holder body can cause said nib to move relative to said holder body due to said core overcoming the grip of said at least one projection.

2. The nib holder of claim 1, wherein said engaging means are cooperating threads on said cylindrical casing and said one end of said holder body whereby said holder body rotates with respect to said casing during the adjustment of the position thereof.

3. The nib holder of claim 2, wherein said at least one holding means is an annular ring.

4. The nib holder of claim 2, including cooperative means on said holder body and said casing for selectively controlling the relative rotation therebetween, said cooperative means comprising a prong on one of said holder body and casing and at least one mating stepped portion on the other of said holder body and casing.

* * * * *